US009666385B2

(12) United States Patent
Liu

(10) Patent No.: US 9,666,385 B2
(45) Date of Patent: May 30, 2017

(54) HOUSING WITH DISASSEMBLY INDICATOR

(71) Applicants: AMBIT MICROSYSTEMS (SHANGHAI) LTD., Shanghai (CN); HON HAI PRECISION INDUSTRY CO., LTD., New Taipei (TW)

(72) Inventor: Pei Liu, Shanghai (CN)

(73) Assignees: AMBIT MICROSYSTEMS (SHANGHAI) LTD., Shanghai (CN); HON HAI PRECISION INDUSTRY CO., LTD., New Taipei (TW)

( * ) Notice: Subject to any disclaimer, the term of this patent is extended or adjusted under 35 U.S.C. 154(b) by 84 days.

(21) Appl. No.: 14/609,684

(22) Filed: Jan. 30, 2015

(65) Prior Publication Data

US 2016/0055986 A1 Feb. 25, 2016

(30) Foreign Application Priority Data

Aug. 19, 2014 (CN) ..... 2014 1 0407503

(51) Int. Cl.
*H01H 9/02* (2006.01)
*H01H 9/16* (2006.01)

(52) U.S. Cl.
CPC ..... *H01H 9/0271* (2013.01); *H01H 9/16* (2013.01); *H01H 2221/044* (2013.01)

(58) Field of Classification Search
CPC ..... H01H 9/02; H01H 9/16; H01H 9/0271; H01H 3/20
USPC ..... 361/781
See application file for complete search history.

(56) References Cited

U.S. PATENT DOCUMENTS 6,064,014 A * 5/2000 McCluskey ..... H01H 11/0056 200/81.4
6,296,367 B1 * 10/2001 Parsons ..... F21L 4/085 320/115
7,256,363 B1 * 8/2007 McConnell ..... H01H 13/20 200/296
2008/0169177 A1 * 7/2008 Yang ..... H01H 9/226 200/331

FOREIGN PATENT DOCUMENTS

CN 201667076 U 12/2010

* cited by examiner

*Primary Examiner* — Eric Thomas
*Assistant Examiner* — Michael P McFadden
(74) *Attorney, Agent, or Firm* — Steven Reiss

(57) ABSTRACT

A housing containing its own record of any private and unwarranted disassembly includes a first shell, a second shell detachably connected with the second shell, a consumer disassembly indication structure. The consumer disassembly indication structure includes a circuit board, a plurality of switches, a computer chip, a plurality of conductive bodies, and a plurality of insulative bodies. The plurality of switches are fixed on the circuit board and each is electrically connected with the computer chip. The computer chip is configured to record electric connections between the conductive bodies and switches, the original electric connections being changed to other or no connections after any disassembly of the housing.

5 Claims, 10 Drawing Sheets

HOUSING WITH DISASSEMBLY INDICATOR

The subject matter herein generally relates to a housing that indicates consumer disassembly.

BACKGROUND

A label is pasted on an electronic device to illustrate whether the electronic device has been privately disassembled during a warranty period. However, the label may also be damaged with normal use of the electronic device, and this may void the warranty.

BRIEF DESCRIPTION OF THE DRAWINGS

Implementations of the present technology will now be described, by way of example only, with reference to the attached figures.

DETAILED DESCRIPTION

Figure 1:
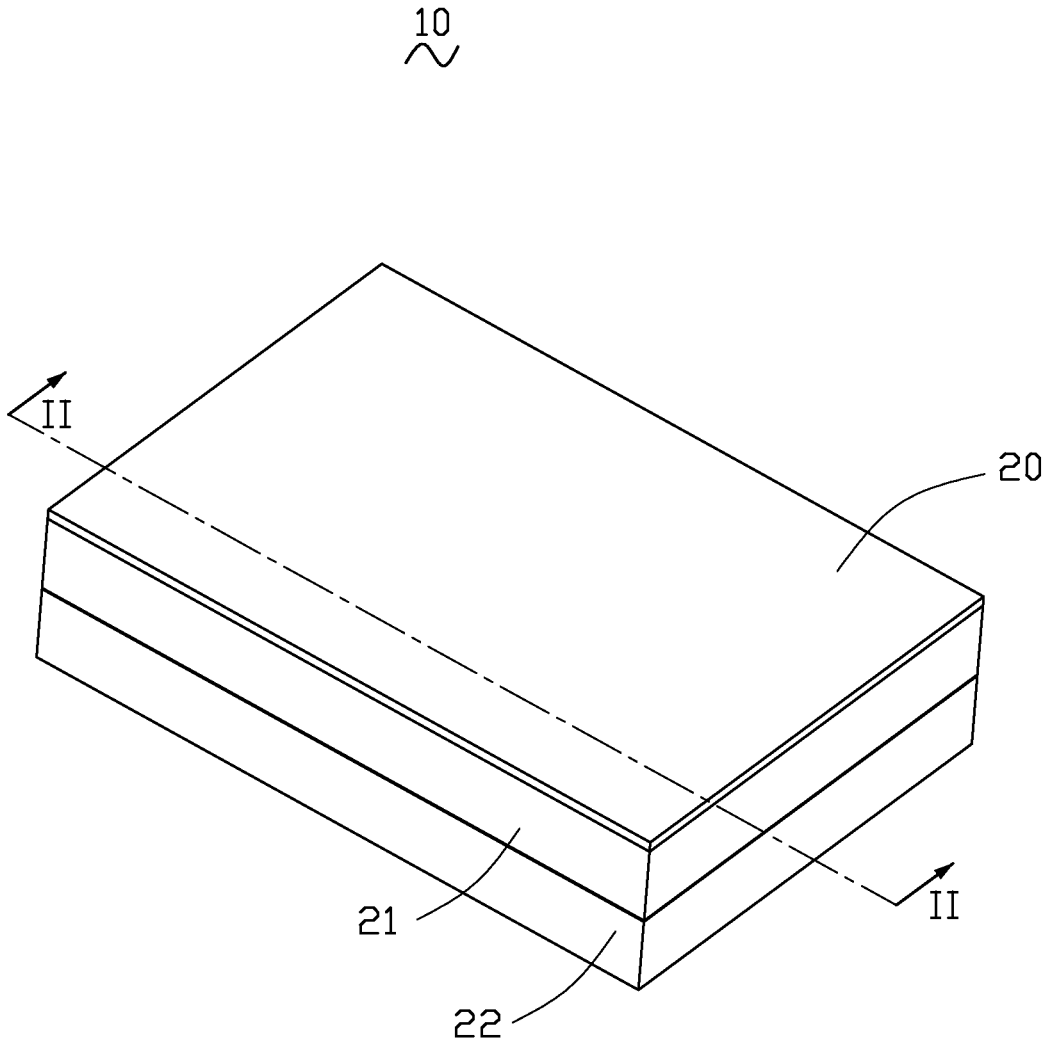
FIG. 1 is an isometric view of a housing with a consumer disassembly indication structure in accordance with a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a housing for incontrovertibly indicating a private disassembly of the housing.

Figure 2:
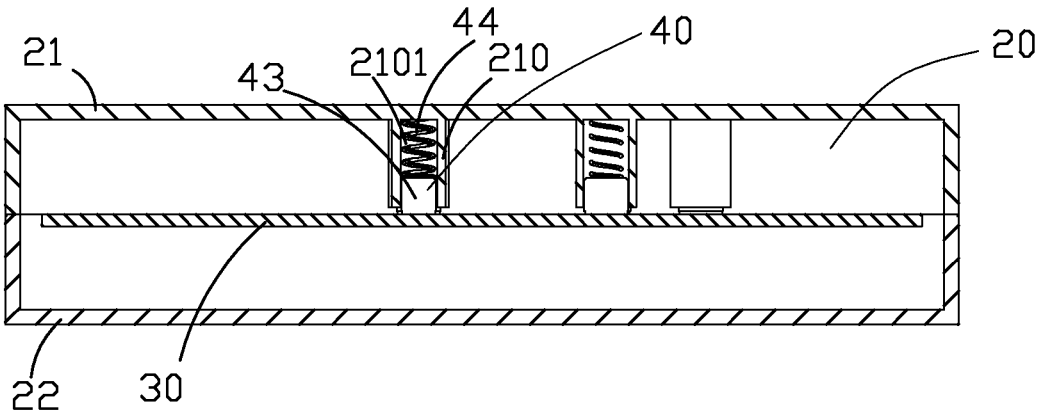
FIG. 2 is a cross sectional view of the housing, taken along line II-II of FIG. 1.

FIGS. 1-2 illustrate a housing 10 of the disclosure which indicates consumer disassembly. The housing 10 includes a circuit board 30, a consumer disassembly indication structure 40, a first shell 21, and a second shell 22 detachably connectable with the first shell 21. A substantially enclosed space 20 is defined to house a product (not shown). The circuit board 30 and the consumer disassembly indication structure 40 are located between the first shell 21 and the second shell 22.

Figure 3:
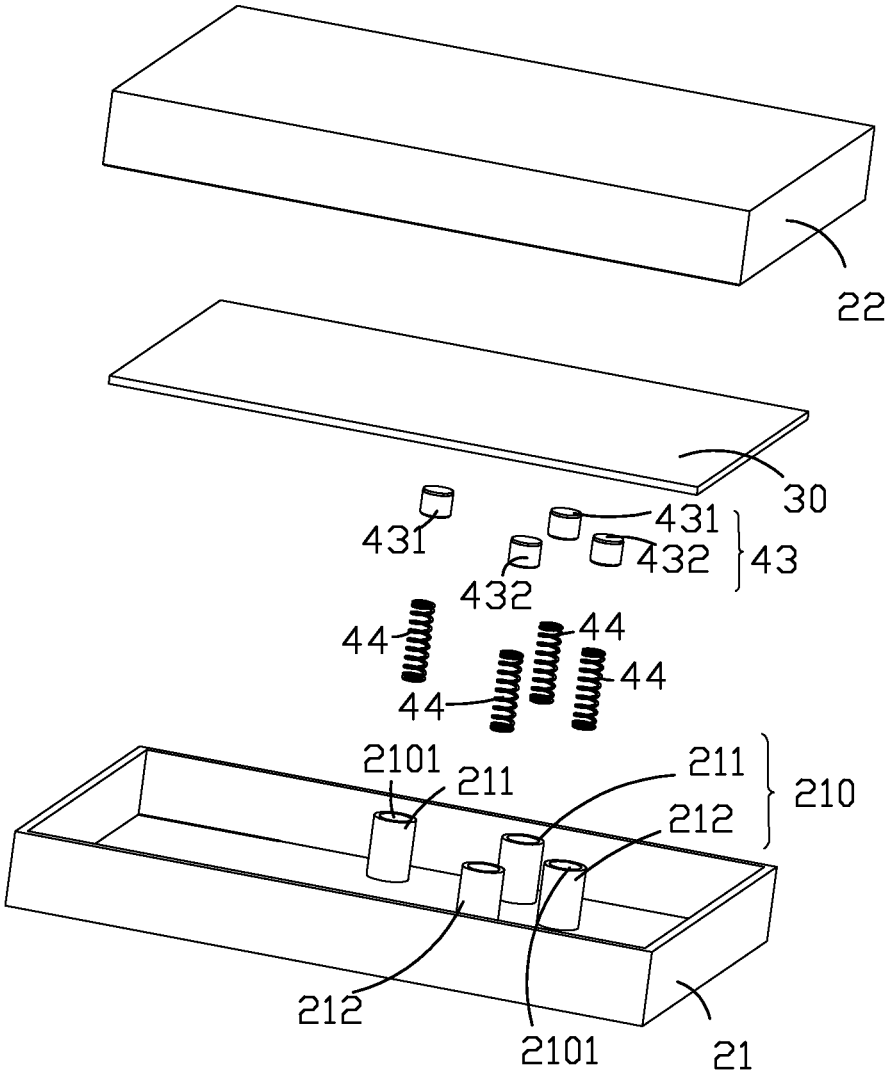
FIG. 3 is an exploded, isometric view of the housing of FIG. 1.
Figure 4:
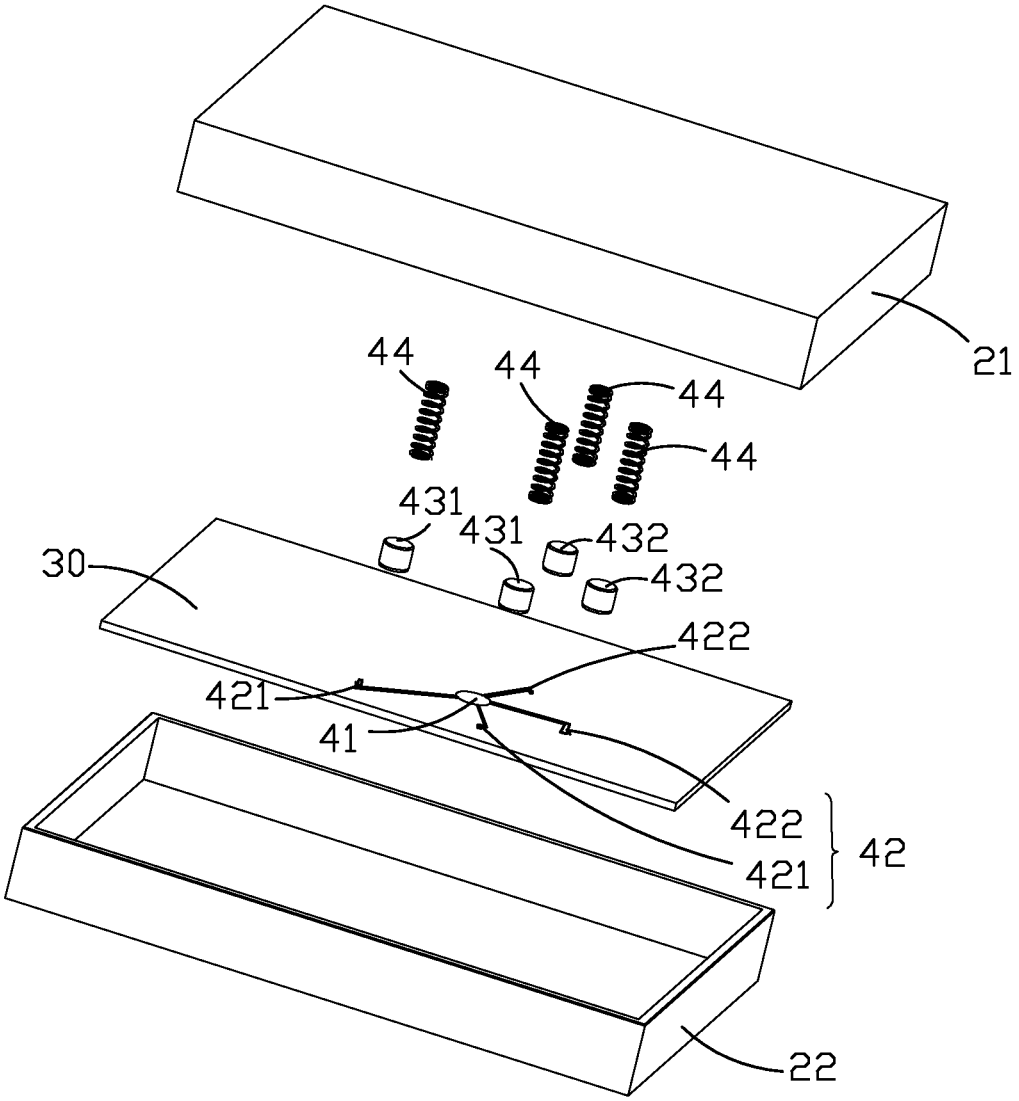
FIG. 4 is another exploded, isometric view of the housing of FIG. 1.
Figure 5:
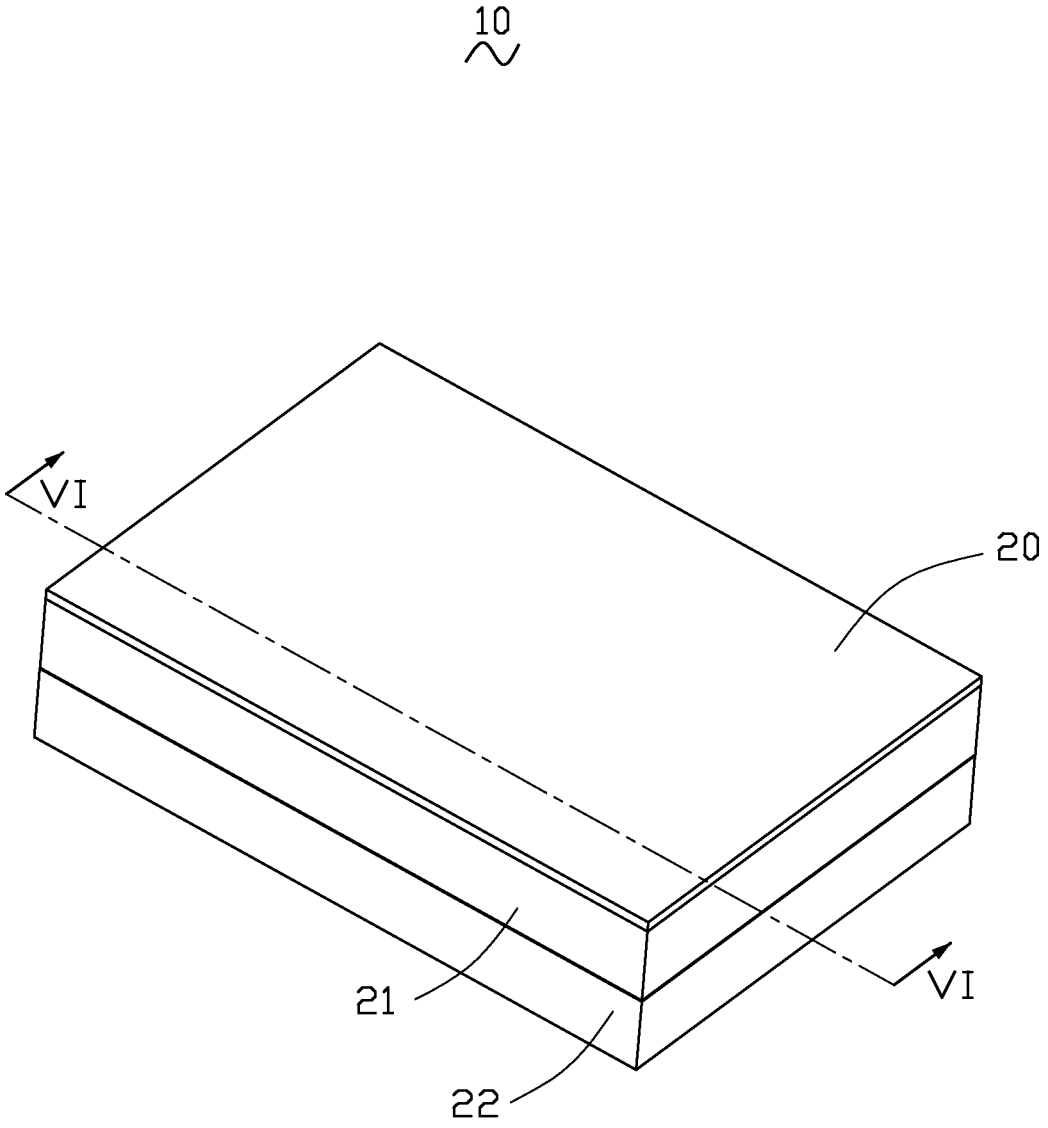
FIG. 5 is another isometric view of a housing with a consumer disassembly indication structure in accordance with a second embodiment.
Figure 6:
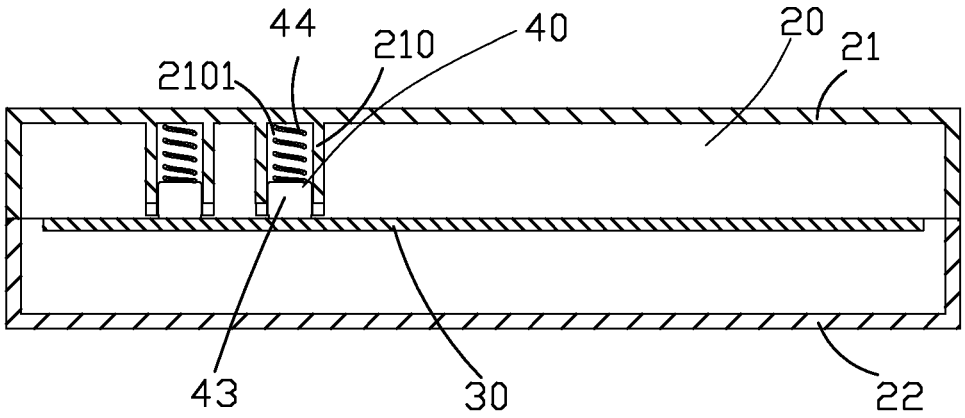
FIG. 6 is a cross sectional view of the housing, taken along line VI-VI of FIG. 5.

FIGS. 3-4 illustrate that the first shell 21 includes a plurality of positioning members 210 protruding from an inner face of the first shell 21 facing the circuit board 30. The plurality of positioning members 210 includes a pair of first positioning members 211, and a pair of second positioning members 212. Each positioning member 210 defines a receiving space 2101.

The consumer disassembly indication structure 40 includes a computer chip 41, a plurality of switches 42, a plurality of connecting bodies 43, and a plurality of elastic members 44. The computer chip 41 and the plurality of switches 42 are fixed on the circuit board 30. The plurality of elastic members 44 and the connecting bodies 43 are received in the receiving spaces 2101. Each of the plurality of elastic members 44 generates an elastic force on the connecting bodies 43 that enables the connecting bodies 43 to couple with the switches 42.

Each of the plurality of switches 42 is in an off state, and is electrically connected with the computer chip 41 by the circuit board 30. The plurality of switches 42 includes two first switches 421 corresponding to the pair of first positioning members 211, and two second switches 422 corresponding to the pair of second positioning members 212.

The plurality of connecting bodies 43 include a pair of conductive bodies 431 which are made of conductive materials, and a pair of insulative bodies 432 which are made of isolated materials. When the first shell 21 is coupled with the second shell 22, the pair of conductive bodies 431 are respectively fixed on the pair of first positioning members 211 and are resisted by the elastic members 44, so that the conductive bodies 431 are electrically coupled with the first switches 421 keeping the pair of first switches 421 turned on, and the pair of insulative bodies 432 are respectively fixed on the pair of second positioning members 212 and are resisted by the elastic members 44 to couple with the second switch 422 keeping the pair of second switches 422 turned off. The conductive bodies 431 and insulative bodies 432 have a same structure.

When the first shell 21 is separated from the second shell 22 by an operation from a user, the elastic members 44 are elastically recovered to separate the conductive bodies 431 and the insulative bodies 432 from the positioning members 21 that make the connecting bodies 43 disconnect from the switches 42. The structures of the conductive bodies 431 and the insulative bodies 432 are identical, and precise reinstatement of the conductive bodies 431 with the first positioning members 211 cannot easily be achieved by the user. The probability is that, in attempted reassembly after the separation, the conductive body 431 can be fixed on a second positioning member 212 rather than on a first positioning member 211, and the insulative connecting body 432 can be fixed on a first positioning member 211 rather than on a second positioning member 212. Thus, the conductive bodies 431 cannot be electrically coupled with the first switches 421.

The computer chip 41 is configured to record and output the connections between the conductive body 431 and the first switch 421, and to generate signals according to the connections. The connection relationships of the conductive body 431 and the first switch 421 can include a first connection relationship in which the conductive body 431 is fixed on the first positioning member 211 to make the conductive body 431 couple with the first switch 421 and the insulative body 432 is fixed on the second positioning member 212 to make the insulative body 432 couple with the second switch 422. A second connection relationship can be that the conductive body 431 is not fixed on the first positioning member 211 or that the insulative body 432 is not fixed on the second positioning member 212. The generated signals include a first signal generated according to the first connection relationship, and a second signal generated according to the second connection relationship. In this embodiment, when the second signal is generated, the housing 10 is rendered incapable of functioning.

Thus, the question of whether the housing 10 has been opened can be determined by accessing the computer chip 41.

In the embodiment, the number of the conductive bodies 431 is two. The number of the insulative bodies 432 is two. In other embodiments, the number of the conductive bodies 431 and the insulative bodies 432 can be more than two.

FIGS. 5-10 illustrate another embodiment of the housing 10 to inhibit consumer disassembly of the disclosure. The housing 10 includes a circuit board 30, a consumer disassembly indication structure 40, a first shell 21, and a second shell 22 detachably connectable with the first shell 21 to define a substantially enclosed space 20 to house the product. The consumer disassembly indication structure 40 and the circuit board 30 are located between the first shell 21 and the second shell 22.

The first shell 21 includes a pair of positioning members 210 protruding from a surface of the first shell 21 facing the circuit board 30. Each positioning member 210 defines a receiving space 2101 and one or more grooves 60.

The consumer disassembly structure 40 includes a computer chip 41, two groups of switches 42 electrically coupled with the computer chip 41, a pair of connecting bodies 43, and a pair of elastic members 44. The computer chip 41 and the two groups of switches 42 are positioned on the circuit board 30. The pair of elastic members 44 and the pair of connecting bodies 43 are received in the receiving space 2101. The connecting bodies 43 are resisted by the elastic members 44 to couple with the switches 42.

Each connecting body 43 includes a conductive body 431 which can conduct electricity, and an insulative body 432 which are electrically isolated. The conductive body 431 is secured on an end of the insulative body 432, and a size of the conductive body 431 is smaller than that of the insulative body 432. The insulative body 432 includes a projection engaged with the groove 60 to limit the insulative body 432 on the positioning member 210.

Figure 7:
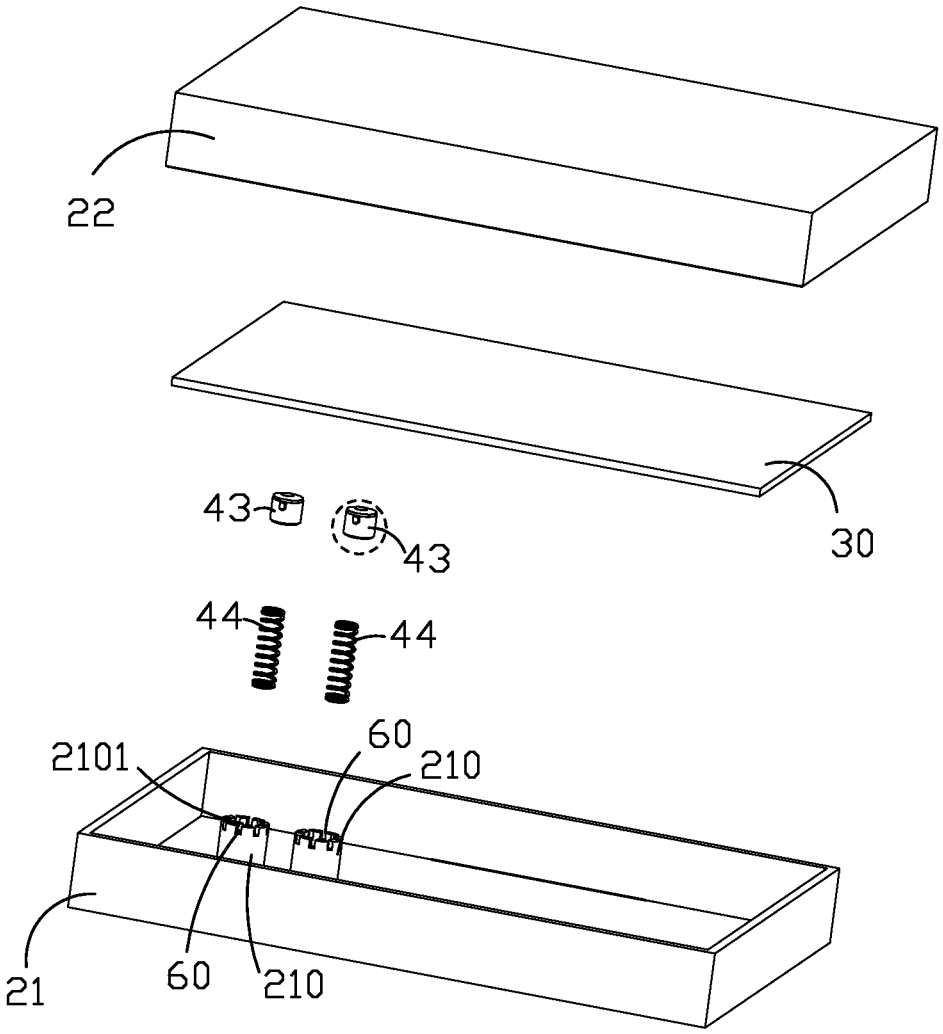
FIG. 7 is an exploded, isometric view of the housing of FIG. 5, wherein the consumer disassembly indication structure includes a connecting body.
Figure 8:
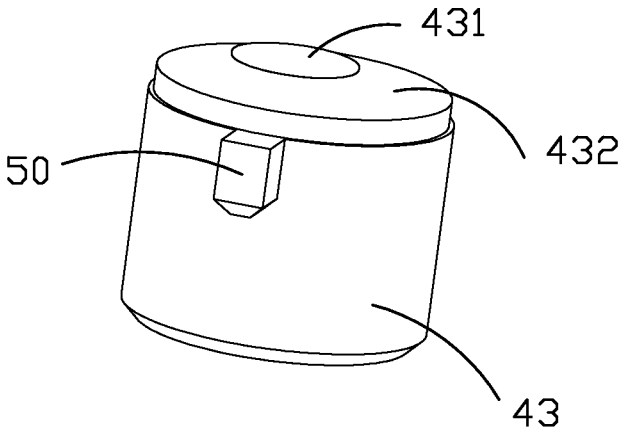
FIG. 8 is an enlarged isometric view of the connecting body of FIG. 7.
Figure 9:
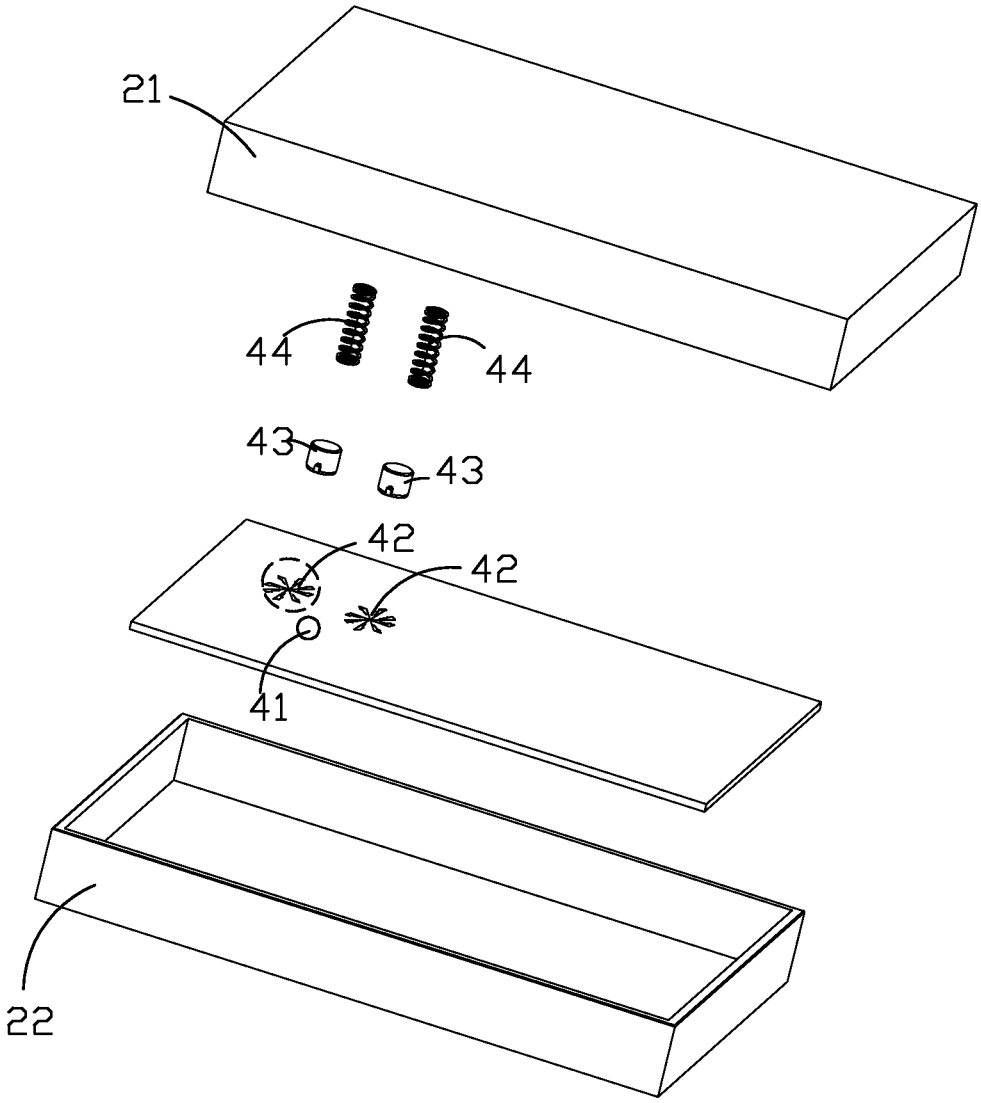
FIG. 9 is another exploded, isometric view of the housing of FIG. 5, wherein the consumer disassembly indication structure includes a plurality of switches.
Figure 10:
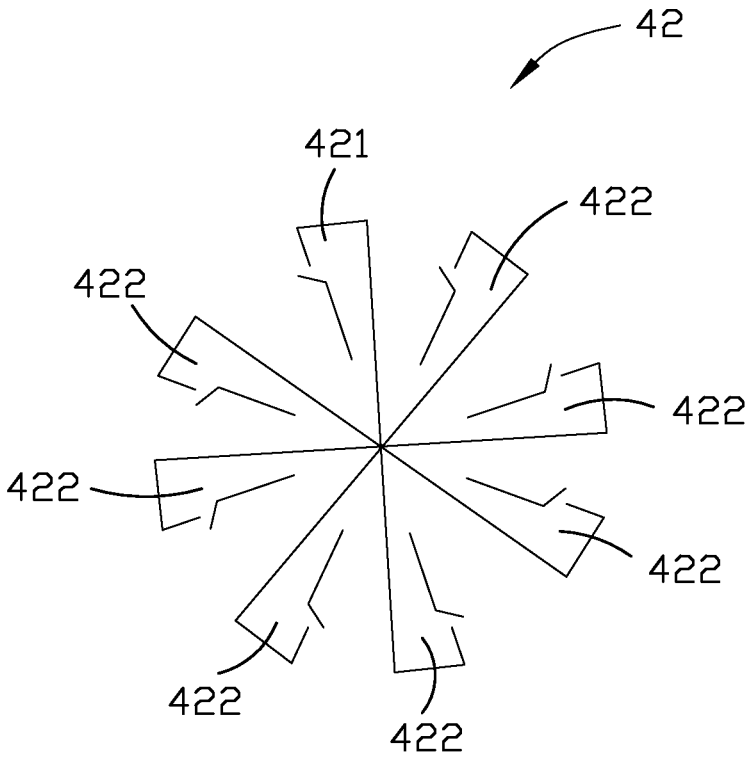
FIG. 10 is an enlarged diagrammatic view of the plurality of switches of FIG. 9.

FIGS. 7-8 illustrate that each group of switches 42 includes a first switch 421 and one or more second switches 422. The first switch 421 and one or more second switches 422 are arranged on the circuit board 30 in a ring. When the first shell 21 is coupled with the second shell 22, the projection is engaged with one of the grooves 60 allowing the conductive body 431 to electrically couple with the first switch 421 to allow conduction, and to couple the insulative body 432 with the second switches 422 keeping the second switches 422 turned off.

When the first shell 21 is separated from the second shell 22 by an operation of a user, the elastic members 44 are elastic recovered to separate the connecting bodies 43 from the positioning members 21 making the conductive body 431 disconnect from the first switch 421. There are various assembly relationships between the grooves 60 and the projection, so precise reinstatement of the conductive body 431 with the first switch 211 cannot be easily achieved by the user. The probability is that, in attempted reassembly after the separation, the conductive body 431 can be electrically coupled with the second switch 422 rather than the first switch 421, and the insulative connecting body 432 can be coupled with the first switch 421 rather than the second switch 422.

The computer chip 41 is configured to record and output the connections between the conductive body 431 and the first switch 421, and to generate signals according to the connections. The connection relationships of the conductive body 431 and the first switch 421 can include a first connection relationship in which the conductive body 431 is coupled with the first switch 421, and a second connection relationship can be that the conductive body 431 is not coupled with the first switch 421. The generated signals include a first signal generated according to the first connection relationship, and a second signal generated according to the second connection relationship. In this embodiment, when the second signal is generated, the housing 10 is rendered incapable of functioning.

Thus, the question of whether the housing 10 has been opened can be determined by accessing the computer chip 41.

The embodiments shown and described above are only examples. Many details are often found in the art such as the other features of a housing. Therefore, many such details are neither shown nor described. Even though numerous characteristics and advantages of the present technology have been set fourth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A housing with a disassembly indicator, comprising:

a first shell;

a second shell detachably connectable with the first shell to define a substantially enclosed space to house a product;

a consumer disassembly indication structure positioned within the substantially enclosed space, the consumer disassembly indication structure comprising:

a circuit board positioned within the substantially enclosed space;

one or more first switches fixed on the circuit board;

one or more second switches fixed on the circuit board;

one or more conductive bodies coupled with the one or more first switches;

one or more insulative bodies coupled with the one or more second switches;

one or more elastic members fixed between the first shell and the one or more conductive bodies or the one ore more insulative bodies, and generating an elastic force on each one of the one or more conductive bodies and the one or more insulative bodies; and a computer chip electrically connected to the one or more first switches and the one or more second switches;

wherein, when the one or more conductive bodies are in contact with the one or more first switches, a first relationship is established;

wherein, when the one or more insulative bodies are in contact with the one or more first switches, a second relationship is established;

wherein, when the first shell is detached from the second shell, the first relationship is broken by the one or more conductive bodies being driven by the elastic force generated by the one or more elastic members to separate from the one or more first switches, and the one or more insulative bodies are driven by the elastic force generated by the one or more elastic members to separate from the one or more second switches;

wherein, when the one or more first shells are reattached to the one or more second shells, the second relationship may be established; and wherein, the computer chip records the establishment of the first relationship and the second relationship, wherein the first shell comprises one or more positioning members corresponding to the one or more first switches and the one or more second switches, the one or more elastic members are fixed on the one or more positioning members, wherein the one or more positioning members comprise one or more first positioning members corresponding to the one or more first switches and one or more second positioning members corresponding to the one or more second switches, the one or more conductive bodies being coupled with the one or more first positioning members, the one or more insulative bodies being coupled with the one or more second positioning members.

2. The housing with the disassembly indicator of claim 1, wherein the one or more conductive bodies and the one or more insulative bodies are identical.

3. The housing with the disassembly indicator of claim 1, wherein one of the one or more conductive bodies are located on one of the one or more insulative bodies.

4. The housing with the disassembly indicator of claim 3, wherein the one or more first shells comprise one or more positioning members, each of the one or more positioning members defines a plurality of grooves, each of the insulative bodies comprises a projection engaged with one of the one or more grooves to limit the insulative body on the positioning member.

5. The housing with the disassembly indicator of claim 4, wherein the one or more first switches and the one or more second switches are arranged on the circuit board in a ring.

* * * * *